US009061329B2

(12) United States Patent
Júnior

(10) Patent No.: US 9,061,329 B2
(45) Date of Patent: Jun. 23, 2015

(54) DEVICE FOR FLUID RECIRCULATION AND TANK CLEANING, AND STORAGE TANK

(75) Inventor: Joel Ligiéro Vargas Júnior, Guaratinguetá (BR)

(73) Assignee: CLEAN HARBORS ENERGY AND INDUSTRIAL SERVICES CORPORATION, Houston, TX (US)

( * ) Notice: Subject to any disclaimer, the term of this patent is extended or adjusted under 35 U.S.C. 154(b) by 944 days.

(21) Appl. No.: 13/131,855

(22) PCT Filed: Aug. 10, 2009

(86) PCT No.: PCT/BR2009/000242

§ 371 (c)(1), (2), (4) Date: Aug. 24, 2011

(87) PCT Pub. No.: WO2010/115250

PCT Pub. Date: Oct. 14, 2010

(65) Prior Publication Data

US 2011/0303249 A1 Dec. 15, 2011

(30) Foreign Application Priority Data

Apr. 8, 2009 (BR) ..... 0900685

(51) Int. Cl.
*B08B 9/093* (2006.01)

(52) U.S. Cl.
CPC ..... *B08B 9/0933* (2013.01); *B08B 9/0936* (2013.01)

(58) Field of Classification Search
CPC ..... B08B 9/0936
See application file for complete search history.

(56) References Cited

U.S. PATENT DOCUMENTS

| | | | | |
|---|---|---|---|---|
| 3,645,452 | A | 2/1972 | Stoeckel et al. | |
| 2004/0089329 | A1 * | 5/2004 | Bijster | 134/167 R |
| 2008/0142042 | A1 | 6/2008 | Bramsen | |

FOREIGN PATENT DOCUMENTS

| | | | |
|---|---|---|---|
| DE | 4301388 | A1 | 8/1993 |
| EP | 1106269 | A | 6/2001 |
| WO | 98703528 | A | 6/1987 |

OTHER PUBLICATIONS

International Search Report for PCT/BR2009/000242 mailed on Feb. 8, 2010.

* cited by examiner

*Primary Examiner* — Jason Ko
(74) *Attorney, Agent, or Firm* — Vedder Price PC

(57) ABSTRACT

A device able to allow for the supply of a pressurized fluid to inner portions of tanks for fluid storage (e.g. petroleum), so as to enable its cleaning or the recirculation of the stored fluids is disclosed. The device includes a revolving element able to allow the flow of pressurized fluids to change its direction inside the tank. Additionally, the device includes a main basis fixed at the tank and having a central orifice which houses the revolving element. The revolving element is arranged to move rotationally around a first geometrical central axis x and around a second geometrical central axis y, wherein the first geometrical central axis x and the second geometrical central axis y form together an angle different from zero. A tank for fluid storage which includes a device for fluid recirculation and tank cleaning is also disclosed.

15 Claims, 5 Drawing Sheets

DEVICE FOR FLUID RECIRCULATION AND TANK CLEANING, AND STORAGE TANK

FIELD OF THE INVENTION

The present invention relates to a device which allows the supply of a fluid into a tank. More particularly, the present invention relates to a device able to allow the supply of a pressurized fluid into the inner portions of tanks for fluid storage (e.g. petroleum), so as to enable its cleaning or the recirculation of the stored fluid.

The present invention also relates to a tank for fluid storage (e.g. petroleum), which comprises a device able to deliver fluids as previously mentioned.

BACKGROUND OF THE INVENTION

At petroleum storehouses, installations and/or industries, tanks and reservoirs are generally used to store petroleum (crude oil), so that, later on, it is processed or transported to other places.

However, such tanks, as they are used over time, build up solid and/or liquid compounds and residues inside them, mainly on the inner surfaces of their walls, their bottom and lid or ceiling. Such residues form mud and sludge which, if not removed periodically, reduce the storage capacity of the tank, a fact obviously unwanted. Moreover, the excess of residues may worsen the quality of the petroleum to be delivered at oil refineries.

Apparatuses which can reduce the volume of mud and sludge and the amount of residues present on the tank bottom are already known.

For instance, patent document EP 1106269 proposes a cleaning apparatus which, in theory, can clean the bottom of a tank for crude oil storage by discharging a fluid stream. Such apparatus comprises a sphere, assembled on a lower portion of the tank wall, having an internal passageway which allows the flow of pressurized fluids coming from a pump to reach the bottom of the tank. This pump reuses the very crude oil from the tank as a cleaning fluid in order to remove unwanted solid or liquid residues. Besides, the apparatus also has an actuator able to move the sphere rotationally. However, as the sphere is fixed on the apparatus by two locking pins diametrically positioned opposing to each other; it can revolve only around one single geometrical central axis, once its movement towards other angle directions is impossible due to the restriction imposed by these two pins.

Therefore, the constructive arrangement and structure of the apparatus described on patent EP 1106269 restrict the rotational movement of the sphere, allowing it to rotate just around a single geometrical central axis, which impairs its capacity to remove mud or sludge. Thus, cleaning the bottom of the tank becomes difficult or even impossible in some specific areas, once the apparatus cannot reach its whole region. Moreover, it is impossible to remove residues from other portions inside the tank, such as the internal surfaces of its wall and lid or ceiling, once a multidirectional movement cannot be imposed to make the sphere revolve around several geometrical axes.

PURPOSES OF THE INVENTION

One purpose of this invention is to provide a device able to clean inner portions of a tank for fluid storage, which shows flexibility and usability, without the need to remove the tank from the place it was installed, in order to cut costs related to its displacement and transportation.

This invention also aims at providing a device able to remove liquid and solid residues from inner surfaces of walls, bottoms and lids of tanks for fluid storage (e.g. petroleum), in a simple and efficient manner, with more flexibility of use compared with other devices and apparatuses already known, without affecting costs.

Besides, this invention also aims at providing an apparatus or device which can supply a fluid to a tank for fluid storage (e.g. petroleum, gasoline, diesel fuel), with significant improvements and enhancements in usability and flexibility, compared with the apparatuses and devices already known, so as to maximize all its potential of use and expand its range of application.

Another purpose of this invention is to provide a device able to allow the recirculation of fluids stored in tanks, in a simple and efficient manner, with more flexibility of use compared with other devices and apparatuses already known, without affecting costs.

The present invention also aims at providing a tank for fluid storage (e.g. petroleum) comprised of a device able to deliver fluids for cleaning and/or recirculation of the fluids stored, as previously mentioned.

SUMMARY OF THE INVENTION

One or more purposes of the invention is/are achieved by providing a device, able to allow the supply of a pressurized fluid into inner portions of tanks for fluid storage (e.g. petroleum), so as to enable its cleaning or the recirculation of the stored fluid. Such device comprises at least a means for fluid conduction able to allow supply of the flow of pressurized fluid inside the tank. Moreover, such device comprises at least a revolving element, able to allow the flow of the pressurized fluids to change its direction inside the tank, associated to the means for fluid conduction. Additionally, such device also comprises a main basis fixed at the tank and containing a central orifice which houses the revolving element. Said revolving element is arranged to move rotationally around a first geometrical central axis $\vec{x}$ and around a second geometrical central axis $\vec{y}$, wherein the first geometrical central axis $\vec{x}$ and the second geometrical central axis $\vec{y}$ form together an angle different from zero.

Therefore, the present invention discloses a device able to clean all the inner portions of a fluid tank (e.g. petroleum) and/or which can allow the recirculation of the fluids stored in such tank. Such device comprises a fluid injecting element (injection nozzle) associated to a pivot sphere (revolving element) which moves at several directions, which allows for a far-reaching operation and, therefore, has more flexibility of use.

The present invention also discloses a tank for fluid storage (e.g. petroleum), which comprises a device for fluid recirculation and tank cleaning, as previously mentioned.

BRIEF DESCRIPTION OF THE DRAWINGS

This invention will be described later in more detail, referring to the attached drawings, in which.

DETAILED DESCRIPTION OF THE FIGURES AND THE INVENTION

Figure 3:
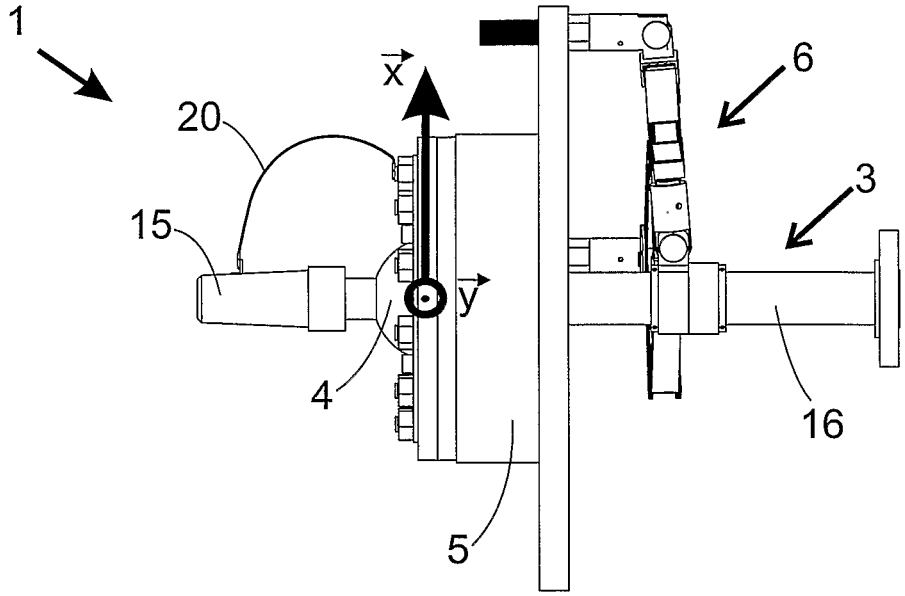
FIG. 3—is a side view of a device for fluid recirculation and tank cleaning, also an object of this invention.

FIG. 3 shows a side view of a device 1 for fluid recirculation and tank 2 cleaning according to a preferred embodiment of the present invention. Such tank 2, able to store petroleum (crude oil) or any other type of fluids, comprises at least a wall 21, lid or ceiling 22 and a bottom 23 associated to each other.

The device 1 for fluid recirculation and cleaning comprises at least a means for fluid conduction 3 able (capable) to allow the supply of the flow of pressurized fluids inside the tank 2. The fluid may be the product stored inside the tank, such as petroleum, water, chemical products or any type of liquid which allows removing liquid or solid residues, such as mud or sludge, which may be found at inner portions of the tank (inner surface of its wall 21, lid or ceiling 22 or bottom 23).

Said means for fluid conduction 3 is associated to a revolving element 4 able to allow the flow of the pressurized fluid to change its direction inside the tank 2. Preferably, the revolving element 4 consists of a pivot sphere.

Besides, the means for fluid conduction 3 is also operatively associated to a fluid source (not shown in the figures) able to supply the pressurized fluid to the means for fluid conduction 3. The fluid source preferably consists of a pump which, in turn, has its inlet associated, for instance, to the tank itself 2, allowing the recirculation of the fluid stored in the tank 2. This association (connection) is made by pipes, ducts and/or connectors.

Optionally, the fluid source (e.g. pump) may have its inlet associated to a reservoir of water or some type of suitable chemical product. In some cases, the tank 2 is emptied out and diesel fuel or other chemical product is applied inside it, in order to dissolve the sludge.

The means for fluid conduction 3 comprises at least an injecting element 15, arranged inside the tank 2, able to deliver the pressurized fluid inside the tank 2. At a preferred embodiment, the injecting element 15 is an injection nozzle, as shown in FIGS. 3 and 5.

Figure 5:
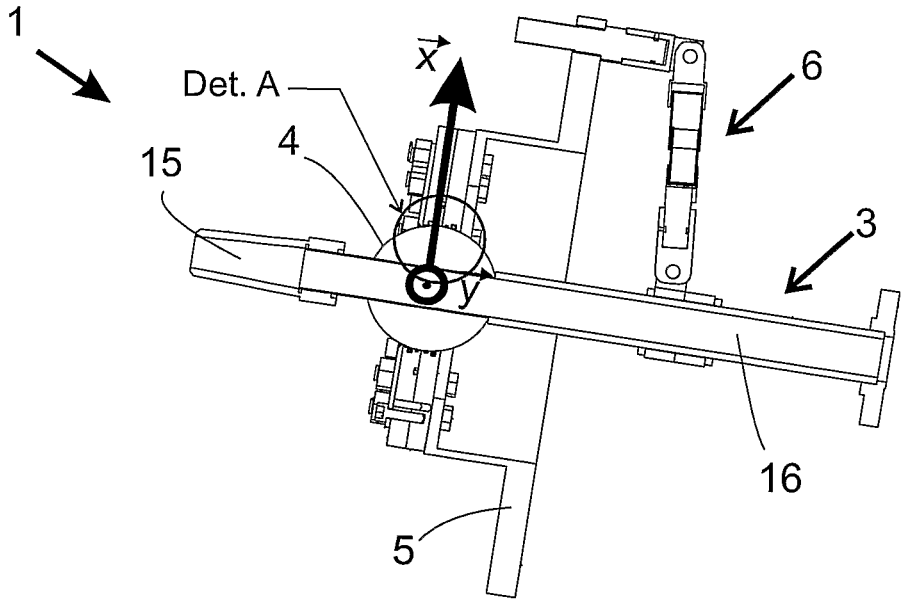
FIG. 5—is a side sectional view of the device shown in FIG. 4.

Additionally, as it can also be seen in FIGS. 3 and 5, the means for fluid conduction 3 also comprises at least a main duct 16 operationally associated to the fluid source and to the injecting element 15 and arranged between both. Such main duct 16 is able to allow the flow of the pressurized fluid from the fluid source to the injecting element 15.

Figure 4:
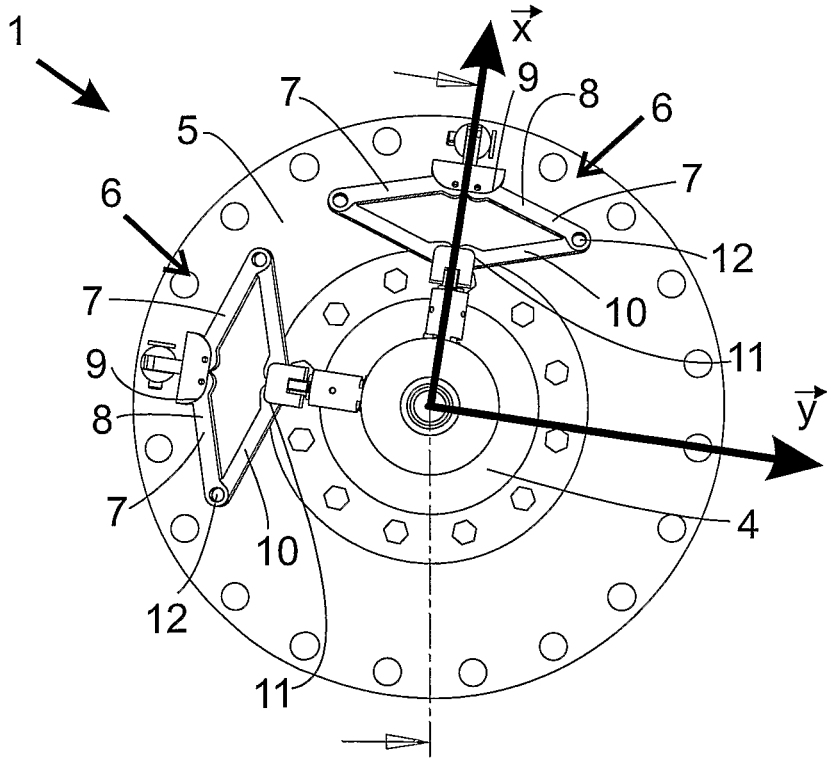
FIG. 4—is a front view of the device shown in FIG. 3.

As it can be seen in FIGS. 3, 4 and 5, the device 1 for fluid recirculation and cleaning also has a main basis 5, fixed at the tank 2, comprising a central orifice which houses the revolving element 4. This main basis 5 is able to support and store the other parts and pieces comprised by the device 1. The main basis 5 may be fixed at the tank 2 by means of screws, rivets or any other suitable mechanical means.

The revolving element 4 is arranged to move rotationally around a first geometrical central axis $\vec{x}$ and around a second geometrical central axis $\vec{y}$, wherein the first geometrical central axis $\vec{x}$ and the second geometrical central axis $\vec{y}$ form together an angle different from zero.

It is worth noting that the expression "geometrical central axis" concerns any geometrical axis which must necessarily cross the geometrical center of the revolving element 4 (pivot sphere).

Preferably, the first geometrical central axis $\vec{x}$ and the second geometrical central axis $\vec{y}$ are substantially perpendicular to each other.

Moreover, the revolving element 4 is arranged to move rotationally around any geometrical central axis belonging to a geometrical plan formed by the first geometrical central axis $\vec{x}$ and the second geometrical central axis $\vec{y}$.

Therefore, considering that the revolving element 4 is able (capable) to move in multiple directions, the injection nozzle (injecting element 15) can move at spherical coordinates (three dimensions), contrary to the apparatus described by document EP 1106269, in which the injection nozzle can move only at planar coordinates (two dimensions). For this reason, the injection nozzle has a far-reaching capacity and can discharge pressurized fluids to regions unreachable before.

The revolving element 4 has an inner channel with a first opening facing the inner side of the tank 2 and a second opening facing the outer side of the tank 2. Such inner channel, able to house at least a portion of the main duct 16, extends over the diameter of the pivot sphere (revolving element 4).

The device 1 for fluid recirculation and cleaning also comprises at least an actuator element 6, associated to the revolving element 4, able to allow the controlling of the rotational movement of the revolving element 4 in multiple directions, either around the first geometrical central axis $\vec{x}$, around the second geometrical central axis $\vec{y}$ or any geometrical central axis belonging to a geometrical plan formed by the first geometrical central axis $\vec{x}$ and the second geometrical central axis $\vec{y}$. Such actuator element 6 may be controlled manually or by means of an automated controller.

As it can be seen in FIG. 4, preferably, the actuator element 6 is a pivot mechanism having at least one pivoting arm 7 comprising:

- a first portion 8 having a first pivoting end 9 associated to the main basis 5; and
- a second portion 10 having a second pivoting end 11 associated to the means for fluid conduction 3.

The first portion 8 and the second portion 10 of the pivoting arm 7 are associated by means of a central hinge 12, wherein the simultaneous movement of the first portion 8 and of the second portion 9 around the central hinge 12 can allow the controlling of the rotational movement of the revolving element in multiple directions.

Alternatively, the actuator element 6 may consist, for instance, of hydraulic or pneumatic cylinders or also any other type of actuator suitable for this application.

Preferably, the pivot mechanism comprises two pivoting arms 7 symmetrically arranged to each other, so as to provide the mechanism with more hardness.

Also preferably, the device 1 for fluid recirculation and cleaning comprises two pivot mechanisms far from each other substantially at an angle of 90°. Obviously, other values of angles may be applied.

Figure 6:
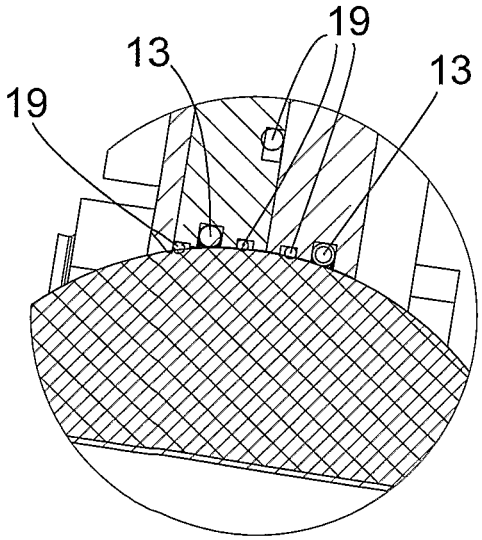
FIG. 6—is an enlargement of a detail (Detail A) of FIG. 5.

As it can be seen in FIG. 6, the device 1 for fluid recirculation and cleaning also comprises at least an auxiliary sphere 13, arranged between the main basis 5 and the pivot sphere (revolving element 4), able to allow the pivot sphere to move rotationally in multiple directions. Such auxiliary sphere 13 has a diameter significantly smaller than the diameter of the pivot sphere (revolving element 4).

Preferably, the device 1 for fluid recirculation and cleaning comprises a plurality auxiliary spheres 13 arranged, for instance, as a row of spheres (ball bearing).

Also pursuant to FIG. 6, the device 1 for fluid recirculation and cleaning comprises at least a sealing ring 19, which is capable of preventing the leaking of pressurized fluids, arranged between the main basis 5 and the revolving element 4. The sealing ring 19 is a ring such as the O-ring made of rubber or silicone. Preferably, the device 1 for fluid recirculation and cleaning comprises several sealing rings 19. The amount and size of the sealing rings 19 may vary and are chosen according to the need and application, to better suit each situation of use.

Figure 7:
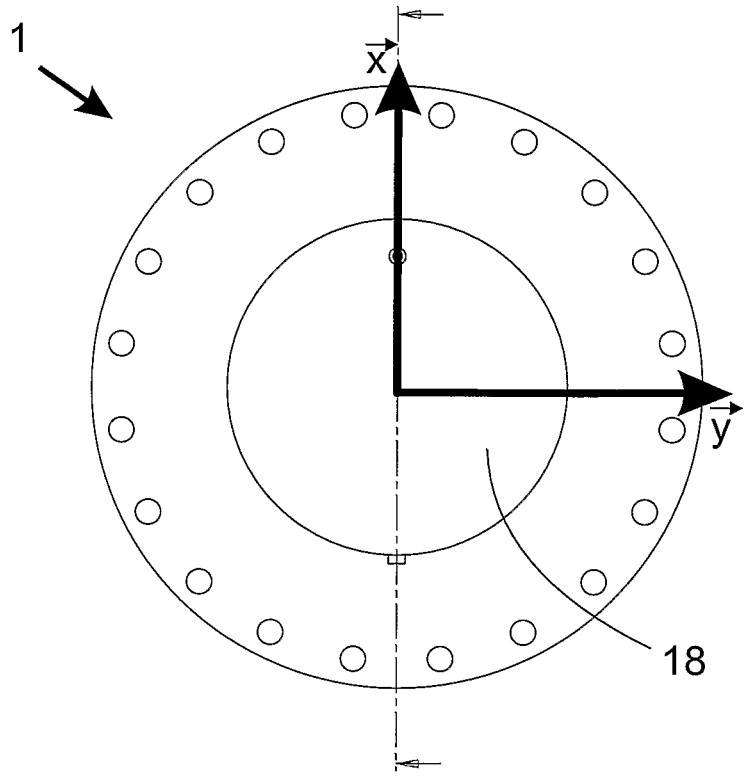
FIG. 7—is a front view of the device shown in FIG. 3, protected by a protection cover.
Figure 8:
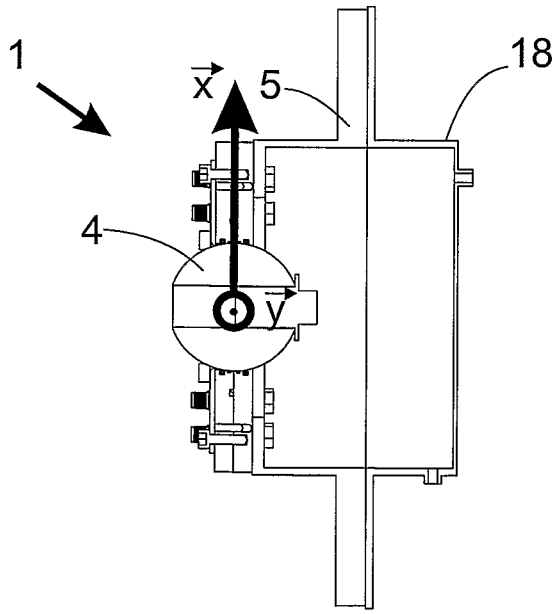
FIG. 8—is a side sectional view of the device shown in FIG. 7.

As it can be seen in FIGS. 7 and 8, the device 1 for fluid recirculation and cleaning also has a protection cover 18 which externally envelops a portion of the device 1 that faces the outer side of the tank 2. Such protection cover 18 can provide the device 1 with a seal when such device is not being used.

The device 1 for fluid recirculation and cleaning also comprises at least a grounding element 20, able to prevent the buildup of static power caused by the fluid flow, simultaneously associated to the injecting element 15 and to the main basis 5. Because of that, it is possible to operate with a volume below the level of the injecting element 15. This is a distinguishing feature compared with the apparatus described in patent document EP 1106269, once it provides more safety in operating the device 1.

Besides, contrary to the apparatus described in patent document EP 1106269, the device of the present invention spares the use of locking pins to fix the pivot sphere (revolving element) at the tank, allowing it to move in multiple directions, so as to enable far-reaching and more efficiency in cleaning, as well as improvement in usability and flexibility.

Additionally, the constructive structure disclosed in this invention enables the use of the device 1 both for the recirculation of the fluid inside the tank—acting as a mixer—and also for cleaning the inner portions of the tank.

It is also worth noting that, although the device 1 in the present invention is preferably applied in tanks for petroleum storage, it can also be used for other types of tanks which store other kinds of fluids. The device 1 can also be used to clean equipments in general.

The present invention also covers a tank 2, able to store petroleum or any other type of fluid, said tank 2 comprising at least a device 1 for fluid recirculation and its cleaning, as previously described.

Figure 1:
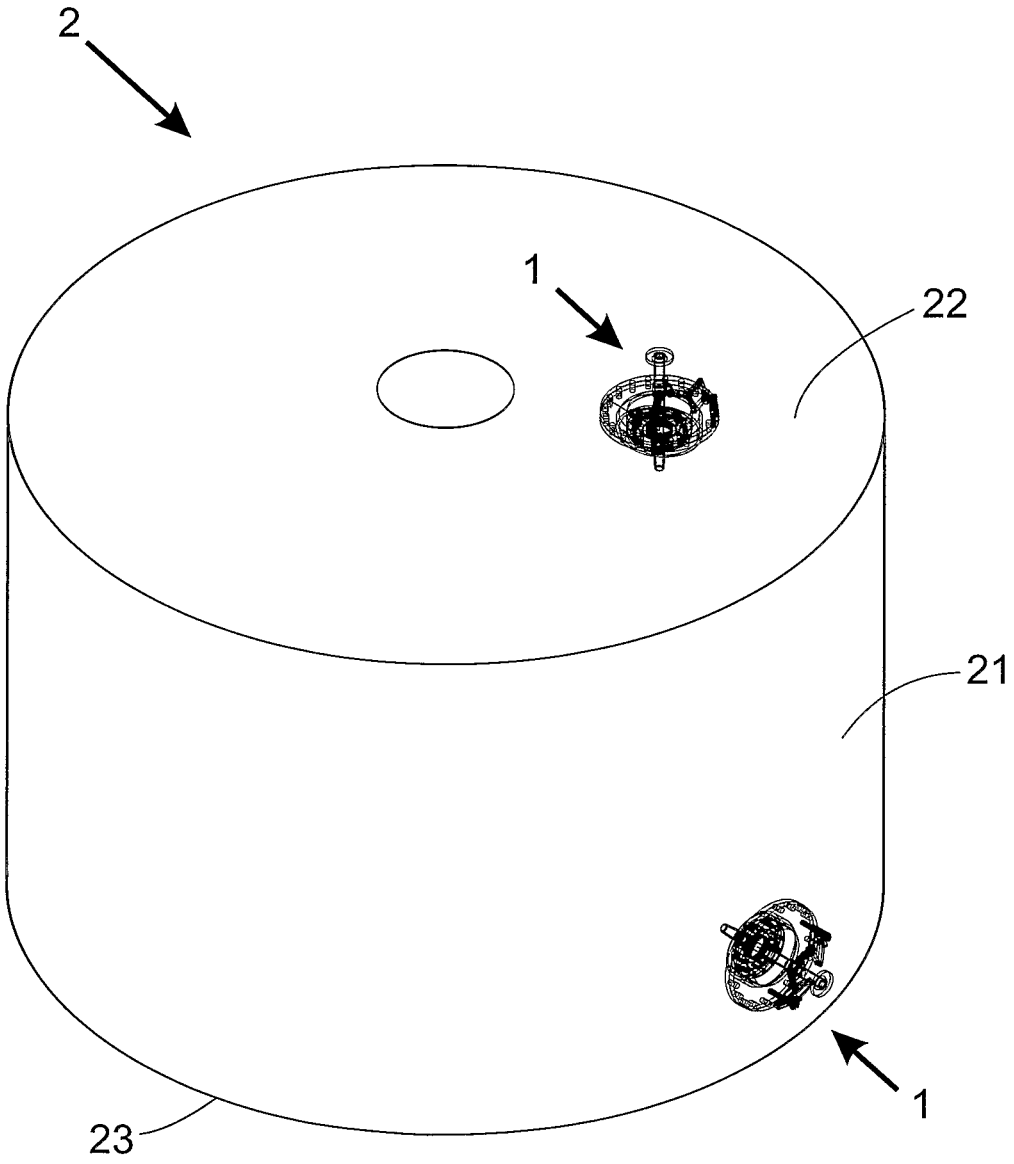
FIG. 1—is a perspective view of a tank for fluid storage, the object of this invention.
Figure 2:
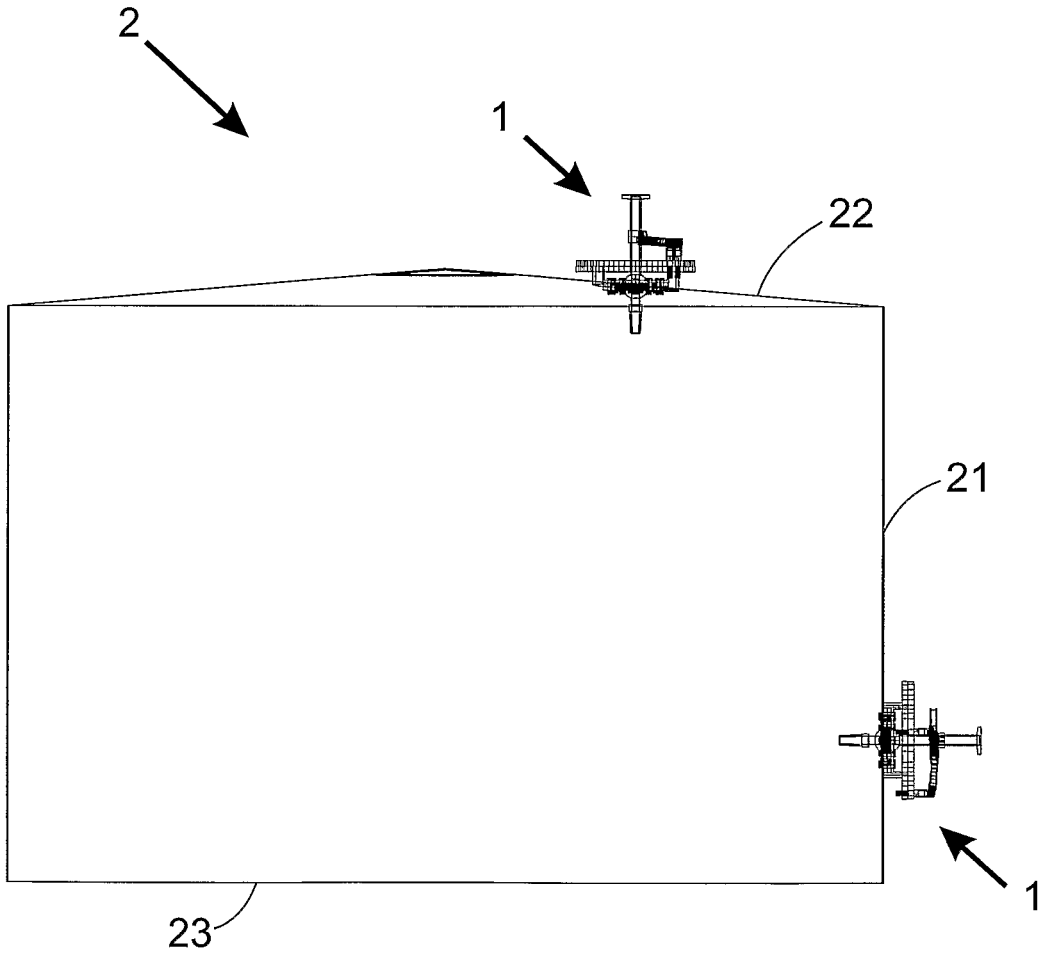
FIG. 2—is a front view of the tank shown in FIG. 1.

As it can be seen in FIGS. 1 and 2, preferably, the tank 2 comprises two devices 1 for fluid recirculation and tank cleaning 2, wherein one of them is located at the lower part of its wall 21 and the other is located on its lid or ceiling 22. The fact that there is a device 1 on the lid or ceiling 22 allows a more powerful impact on the sludge to be removed, which, many times, is so solid that it cannot be cleaned by conventional cleaning apparatuses, as the one disclosed by patent document EP 1106269.

Moreover, the combined operation of both devices 1 provides completely covering of the inner portions of the tank 2 (inner surface of its wall 21, lid or ceiling 22 or bottom 23) in a very efficient manner.

It is worth noting that the apparatus described on patent document EP 1106269 cannot be implemented on the lid or ceiling 22 of the tank (reservoir), once the existence of locking pins prevents its adequate installation.

After describing an example of a preferred embodiment, it shall be understood that the scope of the present invention encompasses other possible variations, being limited only by the contents of the attached claims, where the possible equivalents are included.

The invention claimed is:

1. A device for fluid recirculation and tank cleaning, wherein the tank is able to store fluids, comprising: a fluid conduction element for supplying the flow of a pressurized fluid inside the tank; a revolving element associated to the fluid conduction element, wherein the revolving element allows the flow of the pressurized fluid to change its direction inside the tank and is arranged to move rotationally around a first geometrical central axis $\vec{x}$ and a second geometrical central axis $\vec{y}$, wherein the first geometrical central axis $\vec{x}$ and the second geometrical central axis $\vec{y}$ form together an angle different from zero and the revolving element comprises a pivot sphere; a main basis fixed at the tank, wherein the main basis has a central orifice which houses the revolving element; and an auxiliary sphere arranged between the main basis and the pivot sphere, wherein the auxiliary sphere is able to allow the rotational movement of the pivot sphere in multiple directions, and the auxiliary sphere has a diameter substantially smaller than the diameter of the pivot sphere.

2. The device of claim 1, wherein the first geometrical central axis $\vec{x}$ and the second geometrical central axis $\vec{y}$ are substantially perpendicular to each other.

3. The device of claim 1, wherein the revolving element is arranged to move rotationally around any geometrical central axis belonging to a geometrical plan formed by the first geometrical central axis $\vec{x}$ and the second geometrical central axis $\vec{y}$.

4. The device of claim 1, further comprising an actuator element associated to the revolving element, wherein the actuator element is able to allow for controlling the rotational movement of the revolving element in multiple directions.

5. The device of claim 4, wherein that the actuator element comprises a pivot mechanism having at least a pivoting arm, the pivot mechanism comprising: a first portion having a first pivoting end associated to the main basis; and a second portion having a second pivoting end associated to the fluid conduction element, wherein the first portion and the second portion of the pivoting arm are associated to each other by a central hinge, wherein the simultaneous movement of the first portion of the pivoting arm and of the second portion of the pivoting arm around the central hinge is able to allow the controlling of the rotational movement of the revolving element in multiple directions.

6. The device of claim 5, wherein the pivot mechanism comprises two pivoting arms symmetrically arranged to each other.

7. The device of claim 5, wherein the actuator element comprises two pivot mechanisms spaced from each at an angle of approximately 90 degree.

8. The device of claim 1, wherein the fluid conduction element is operatively associated to a fluid source able to supply the pressurized fluid to the fluid conduction element.

9. The device of claim 8, wherein the fluid conduction element comprises an injecting element arranged inside the tank, wherein the injecting element is able to deliver the pressurized fluid originating from the fluid source to inner portions of the tank.

10. The device of claim 9, wherein the fluid conduction element comprises at least a main duct operatively associated to the fluid source and to the injecting element, wherein the main duct is able to allow the pressurized fluid originating from the fluid source to flow into the injecting element.

11. The device of claim 10, wherein the revolving element comprises an inner channel with a first opening facing the inner side of the tank and a second opening facing the outer side of the tank, wherein such inner channel is able to house at least a portion of the main duct.

12. The device of claim 1, further comprising a protection cover which envelops externally at least a portion of the device which faces the outer side of the tank.

13. The device of claim 1, further comprising a sealing ring arranged between the main basis and the revolving element, wherein the sealing ring is able to prevent the leaking of pressurized fluids.

14. The device of claim 1, further comprising a grounding element simultaneously associated to the injecting element and to the main basis, wherein the grounding element is able to prevent the buildup of static power.

15. A device for fluid recirculation and tank cleaning, wherein the tank is able to store fluids, comprising: a fluid conduction element for supplying the flow of a pressurized fluid inside the tank, wherein the fluid conduction element is operatively associated to a fluid source able to supply the pressurized fluid to the fluid connection element, the fluid conduction element comprises an injecting element arranged inside the tank, wherein the injecting element is able to deliver the pressurized fluid originating from the fluid source to inner portions of the tank, the fluid connection element comprises at least a main duct operatively associated to the fluid source and to the injecting element, wherein the main duct is able to allow the pressurized fluid originating from the fluid source to flow into the injecting element; a revolving element associated to the fluid conduction element, wherein the revolving element allows the flow of the pressurized fluid to change its direction inside the tank and is arranged to move rotationally around a first geometrical central axis $\vec{x}$ and a second geometrical central axis $\vec{y}$, wherein the first geometrical central axis $\vec{x}$ and the second geometrical central axis $\vec{y}$ form together an angle different from zero and comprises an inner channel with a first opening facing the inner side of the tank and a second opening facing the outer side of the tank, wherein such inner channel is able to house at least a portion of the main duct; and a main basis fixed at the tank, wherein the main basis has a central orifice which houses the revolving element.

* * * * *